US006013980A

United States Patent [19]

Goel et al.

[11] Patent Number: 6,013,980

[45] Date of Patent: Jan. 11, 2000

[54] ELECTRICALLY TUNABLE LOW SECONDARY ELECTRON EMISSION DIAMOND-LIKE COATINGS AND PROCESS FOR DEPOSITING COATINGS

[75] Inventors: Arvind Goel; Craig Anthony Outten, both of Buffalo, N.Y.

[73] Assignee: Advanced Refractory Technologies, Inc., Buffalo, N.Y.

[21] Appl. No.: 08/853,929

[22] Filed: May 9, 1997

[51] Int. Cl.[7] ..... H01J 19/42

[52] U.S. Cl. ..... 313/495; 313/422; 313/292; 313/309; 313/107

[58] Field of Search ..... 313/495, 497, 313/292, 283, 288, 309, 310, 336, 351, 422, 106, 107

[56] References Cited

U.S. PATENT DOCUMENTS

| | | |
|---|---|---|
| 4,191,735 | 3/1980 | Nelson et al. . |
| 4,783,368 | 11/1988 | Yamamoto et al. . |
| 4,816,291 | 3/1989 | Desphandey et al. . |
| 4,822,466 | 4/1989 | Radalais et al. . |
| 4,842,937 | 6/1989 | Meyer et al. . |
| 4,877,677 | 10/1989 | Hirocki et al. . |
| 4,897,829 | 1/1990 | Ikoma et al. . |
| 4,915,977 | 4/1990 | Okamoto et al. . |
| 4,948,388 | 8/1990 | Ringwood . |
| 4,960,643 | 10/1990 | Lemelson . |
| 4,961,958 | 10/1990 | Desphandey et al. . |
| 4,980,021 | 12/1990 | Kitamura et al. . |
| 4,985,051 | 1/1991 | Ringwood . |
| 4,992,298 | 2/1991 | Deutchman et al. . |
| 5,002,899 | 3/1991 | Gels et al. . |
| 5,040,501 | 8/1991 | Lemelson . |
| 5,055,318 | 10/1991 | Deutchman et al. . |
| 5,064,801 | 11/1991 | Juntgen et al. . |
| 5,068,148 | 11/1991 | Nakahara et al. . |
| 5,077,103 | 12/1991 | Wagner et al. . |
| 5,087,434 | 2/1992 | Frenklach et al. . |
| 5,094,915 | 3/1992 | Subramaniam . |
| 5,100,424 | 3/1992 | Jang et al. . |
| 5,101,288 | 3/1992 | Ohta et al. . |
| 5,110,577 | 5/1992 | Tamor et al. . |
| 5,117,299 | 5/1992 | Kondo et al. . |
| 5,135,808 | 8/1992 | Kimock et al. . |
| 5,137,784 | 8/1992 | Suzuki et al. . |
| 5,142,390 | 8/1992 | Ohta et al. . |

(List continued on next page.)

OTHER PUBLICATIONS

Dorfman, "Diamond–like Nanocomposites (DNL)," *Thin Solid Films*, 212:267–273, Dec. 1992.

Dorfman et al., *Sov. Phys. Dokl.,* 28:743 (English Abstract), Dec. 1983.

Dorfman, "Synthesis of Solid State Structure," *Metallurgia*, Moscow, Dec. 1986.

Dorfman et al., Diamond Films '90, Proc. 1st European Conf. On Diamond and Diamond–like Carbon Coatings, Crans–Montana, Dec. 1990.

Dorfman et al., *Sov. Tech. Phys. Lett.,* 14(6):455–457, Dec. 1988.

Groudeva–Zotova et al., "Secondary Electron Emission Coefficient of C:H and Si:C Thin Films and Some Relations To Their Morphology and Composition," *Diamond and Related Materials*, 5:1087–1095, Feb. 1996.

*Primary Examiner*—Ashok Patel
*Attorney, Agent, or Firm*—Nixon Peabody LLP

[57] ABSTRACT

A diamond-like carbon-containing material useful as a coating for electronic devices including field emission devices and color television tubes, the coatings having both low secondary electron emission coefficients of less than unity and electrical resistivity tunable over a range of from about 10 $e^{-2}$ to about 10 $e^{16}$.

23 Claims, 4 Drawing Sheets

U.S. PATENT DOCUMENTS 5,169,579 12/1992 Marcus et al. .
5,171,732 12/1992 Hed .
5,174,983 12/1992 Snail .
5,183,602 2/1993 Raj et al. .
5,190,807 3/1993 Kimock et al. .
5,198,285 3/1993 Arai et al. .
5,202,571 4/1993 Hirabayashi et al. .
5,206,083 4/1993 Raj et al. .
5,210,430 5/1993 Taniguchi et al. .
5,219,769 6/1993 Yonehara et al. .
5,243,199 9/1993 Shiomi et al. .
5,256,483 10/1993 Yamazaki et al. .
5,306,529 4/1994 Nishimura .
5,346,600 9/1994 Nieh et al. .
5,352,493 10/1994 Dorfman et al. .
5,446,431 8/1995 Dorfman et al. .
5,532,548 7/1996 Spindt et al. .
5,614,781 3/1997 Spindt et al. .
5,728,465 3/1998 Dorfman et al. .
5,742,117 4/1998 Spindt et al. ..... 313/292 X
5,760,538 6/1998 Mitsutake et al. ..... 313/308 X
5,763,997 6/1998 Kumar ..... 313/497 X

ELECTRICALLY TUNABLE LOW SECONDARY ELECTRON EMISSION DIAMOND-LIKE COATINGS AND PROCESS FOR DEPOSITING COATINGS

FIELD OF THE INVENTION

The present invention relates to the field of diamond-like carbon-containing coatings, products coated with such coatings, and the use of such coatings on electronic devices and coatings on components for such devices. More specifically, the present invention relates to dielectric diamond-like carbon-containing coatings, comprising an amorphous matrix, that possess low secondary electron emission coefficients, coated on various substrate materials, such as electrical displays. The coatings are "tunable" with respect to electrical conductivity/resistivity.

BACKGROUND OF THE INVENTION

Field emission displays (FEDs) are a type of thin, lightweight, flat panel information display. These displays are, in effect, flat cathode ray tubes that use matrix-addressed cold cathodes to produce light from a cathodoluminescent phosphor screen. FEDs consists of a field emission array, dielectric spacers, and a phosphor-coated (monochrome or color) faceplate with matrix-addressable electronics. The field emission array comprises electron emitters, each smaller than an individual pixel, that might employ gate electrodes. The electron emitter material may be shaped in any geometrical configuration (e.g. shaft tip, line edge, plane, etc.). Electrons are emitted into a vacuum when an electric field of sufficient strength is applied to the emitter material. The electrons are accelerated to an electron target such as the phosphor-coated screen. The phosphor then luminesces and the pixel "turns on".

FEDs employ high voltage spacers, typically comprising dielectric materials such as ceramics, glass, or high temperature plastics to separate the emitting plate from the phosphor plate. The spacing between the emitter and the phosphor is very small (about 1–10 mm) and is critical to optimal display performance. The spacers must meet several requirements, such as high dielectric strength, resistance to surface flashover, low secondary electron emission, low leakage current, ability to dissipate electrostatic charge, and good mechanical strength. In addition, these materials must maintain these properties under high energy electron bombardment for extended periods. In operation, many dielectric materials are prone to surface flashover, dielectric breakdown, and poor electronic control. It has been exceedingly difficult in the field to find a material which meets the above requirements, especially the control of secondary electron emission and charging.

Dielectric spacers are used in field emission displays (FEDs) to separate the anode faceplate (screen) from the cathode material. Preferably, such spacers must possess a high dielectric strength (greater than about $10^6$ V/cm), high electrical resistance (from about $10^{+8}$ to about $10^{+11}$ ohm-cm), high resistance to flashover, good thermal conductivity and resistance to arcing damage. Furthermore, the structural and chemical properties of the spacers must not change throughout the operational lifetime of the display (greater than about 10,000 hours).

Presently, dielectric spacers are most commonly made from bulk substrate materials, such as glass and ceramics. These materials satisfy the FEDs' dielectric strength requirements but have limited ranges of electrical resistivity and have secondary electron emission coefficients (SEEC) typically much greater than unity (greater than 1.0), for example 2.0 to 3.5. Primary electron refer to electrons from a source, such as an electron beam, which impact a substrate surface. Secondary electron emission refers to the electrons which are emitted from a substrate surface after being impacted by primary electrons. The secondary electron emission coefficient (SEEC) is a ratio value representing the average number of secondary electrons emitted from a bombarded substrate surface for every incident primary electron on the substrate surface.

A material which meets the dielectric strength requirements for desired electrical applications, including use with FEDs, and which also has electrical resistivity values that can be predictably altered, or "tuned", while also having a SEEC value of less than unity (less than 1.0), is presently unknown, but would be advantageous. The present invention relates to the unexpected results that the present coatings are much thinner than those known and provide a low secondary electron emission coefficient of less than about 1.0, while maintaining all other desirable properties, and providing for high productivity and lower cost.

Such a material as described above would also benefit other applications. Color picture tubes use either perforated shadow masks or grilles with vertical slits to direct electron trajectory to an electron target, typically a phosphor coated screen. Electrons from the tube's electron guns pass through the mask or grille and are directed at slightly different angles to excite a red, blue, or green phosphor. Precise alignment of the electron beams is required to achieve sharp images with high contrast. Some fraction of the electrons typically fall on the mask or grille and generate secondary electrons. This may result in defocusing of the image-forming beam due to its interaction with the secondary electrons which have uncontrolled trajectories. Higher resolution images and enhanced brightness and contrast can be achieved if the production of secondary electrons is suppressed or eliminated.

Carbon-containing coatings have been applied to electrical components that are bombarded by electrons. Carbon has many distinct phases, for example, diamond, graphite, soot, etc. Each of these carbon phases has a different secondary electron emission coefficient, or SEEC, for example diamond=2.8; graphite=1.0; and soot=0.45. Certain applications, including electronic displays or other component parts incorporated into electronics under vacuum, require coatings or substrate materials having a SEEC of a specified value. Many electronics applications require coatings having extremely low SEEC values, for example, <1.0 in combination with other properties such as durability, adhesion and smoothness. Certain C:H and Si:C thin films have been attempted for use with high frequency waveguides. Such films as reported by Groudeva-Zotova et al. (*Diamond and Related Materials*, Vol. 5, Nov. 10, 1987), have low SEEC values in the energy range of from 250–2000 eV. The SEEC on these films is very sensitive to film composition and morphology. Also they must be annealed to lower the SEEC. Finally, the electrical resistivity cannot be tailored. In addition, coatings containing graphite in the form of Aquadag (Acheson Colloids, Port Huron, Mich.), vacuum pyrolyzed graphite, and lamp black deposited by electrophoresis, have been used on high frequency electronic devices to prevent multi-pactor discharges (surface flashover). However, these films often must be applied at paint thicknesses of from 10 $\mu$m to over 100 $\mu$m. This creates adhesion problems and other limitations adversely affecting electrical tailorability, durability, stability and smoothness. Further, U.S. Pat. No. 5,466,431 discloses a 0.5 to 2.0 micron thick two network nanocomposite film having a high thermal conductivity and low secondary emission used as a protective coating on the grids of color TV tubes. However, such thick coatings are not only unnecessary, but are also disadvantageous for display applications. Coatings at such thicknesses have a high cost, lower overall productivity due to long deposition times, and low equipment efficiency. Such a thick film coating may also cause variations in critical physical dimensions of the substrate.

As a result, low SEEC coatings which can be applied at required thicknesses and which have no adhesion problem are not known. Coatings for electronic components, especially FEDs and cathode ray tubes, which have both a low SEEC (of less than about unity, i.e. less than about 1.0) and which have superior adhesion and are electrically tunable over a broad range would be highly advantageous.

SUMMARY OF THE INVENTION

The present invention relates to electrical devices having improved performance. Such devices comprise components having coatings made from materials that have low secondary electron emission coefficients, preferably less than about one. In a particularly preferred embodiment, the coating materials with SEECs less than about 1.0 further are electrically tunable, in terms of resistance, over a range of from $10^{-2}$ to $10^{16}$ ohm-cm. and display their low SEEC value of less than about 1.0 over an electron energy range of from about 80 to about 10,000 eV.

In a further embodiment, the present invention is directed to a display comprising an electron target substrate and an electron source on one side of the substrate and a coating on the same side of the substrate as the electron source. In one preferred embodiment the electron target is a generally transparent substrate.

In a further embodiment, the present invention is directed to a device having an electron source and a target arranged so that electrons from the source impinge on the target, and a passive element. The target and passive element and source are positioned so that electrons from the source may impinge on the passive element, and secondary electrons emitted from the passive element impinge on the target. The surface of the passive element has a coating comprising carbon and silicon for reducing the secondary electron emission coefficient of the surface to less than about one. The target optionally comprises the coating. The coating is preferably deposited at a thickness of from about 0.02 to about 0.15 microns.

In a further embodiment of the present invention, the source comprises an electron gun and the target comprises an electroluminescent screen.

A still further embodiment of the present invention is directed to an electrical device such as, for example a display device including a field emission display or a color television tube comprising a coating comprising carbon and silicon on a surface for reducing the secondary electron emission coefficient of the surface to less than about one.

A further embodiment of the present invention is directed to a method of improving the performance of an electrical device comprising providing an electrical device comprising an electron source, an electron target and a passive element, positioning the source, the target and the passive element so that electrons from the source may impinge on the passive element, and secondary electrons emitted from the passive element impinge on the target, and depositing on the passive element a coating comprising carbon and silicon on a surface of the passive element for reducing the secondary electron emission coefficient of the surface to less than about one.

In another embodiment, the present invention comprises an electrical component in a device comprising a substrate and a coating made from a material having a SEEC value less than or close to unity. Preferably the SEEC value of the coating is in a range of from about 1.0 to about 0.45, more preferably from about 0.9 to about 0.45, and most preferably from about 0.90 to about 0.80. The coating is further preferably electrically tunable over a range of from about $10^{-2}$ to $10^{16}$ ohm-cm, and more preferably from about $10^{6}$ to about $10^{10}$ ohm-cm.

In a further embodiment, the present invention relates to a diamond-like material comprising carbon, hydrogen, silicon and oxygen. Optionally, the material further comprises dopant elements or dopant compounds comprising elements from Groups 1–7b of the periodic table.

In a still further embodiment, the invention relates to an electronic device display comprising a substrate and a coating having a low secondary electron emission coefficient, preferably less than unity, and that is tunable in terms of electrical resistivity over a wide range, such as about $10^{-2}$ to about $10^{16}$ ohm-cm.

Still further, the present invention relates to a method of improving the performance of an electrical component display, especially a flat panel display comprising providing an electrical component and coating the component with a material having a secondary electron emission coefficient less than unity.

DETAILED DESCRIPTION OF THE INVENTION

Figure 1:
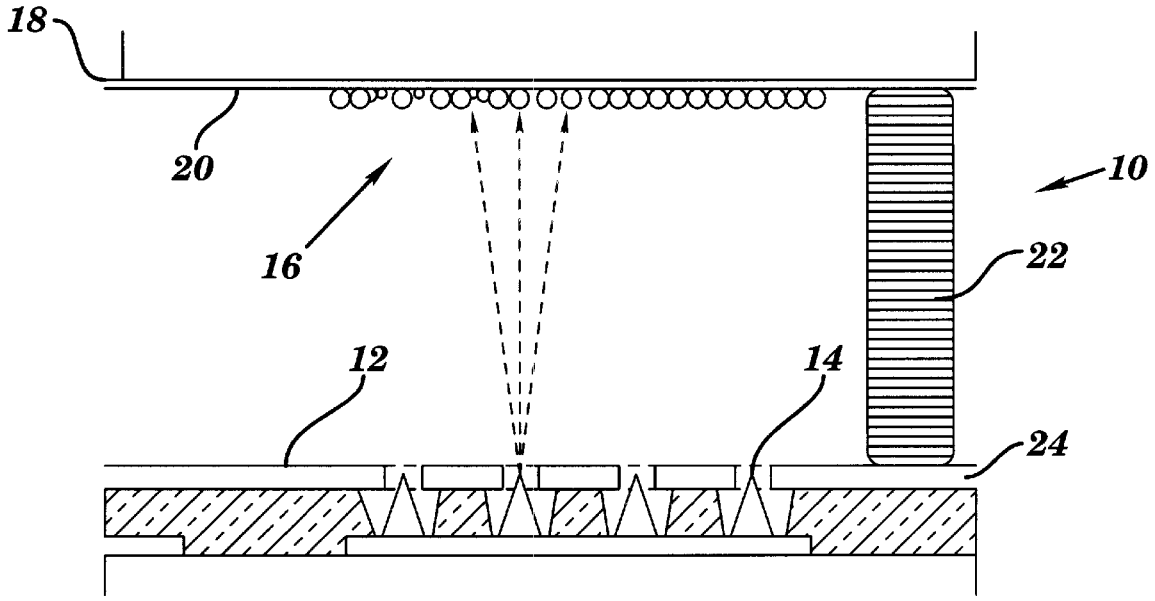
FIG. 1 is a schematic representation of a field emitter display.

FIG. 1 shows one preferred electronic device of the present invention which comprises coatings having extremely low SEECs. FIG. 1 shows a cross-sectional view of a basic FED device 10. Each pixel element 12 comprises an array of emitters 14. Matrix addressing, similar to the thin film transistor in a liquid crystal display, is used to select the proper pixel elements. The emitter rows are driven by a negative voltage signal and the gate columns by a positive signal. Phosphor 16 is deposited on a glass plate 18 covered with a layer of conductive transparent indium tin oxide 20. The phosphor is separated by spacers 22 from the base plate 24.

When a pixel is addressed, a fraction of the primary electrons from the field emitter strike the adjacent spacer walls and can initiate flashover events. Tube voltages can fluctuate and electronic control is difficult. In some cases, this sequence of events results in catastrophic failure of the spacer, i.e. dielectric breakdown, and the pixels, or even the entire display can then no longer operate. Even when complete failure does not occur, the spacer walls are illuminated by the primary and secondary electron, the walls become visible, and the image quality becomes very poor. In addition, the secondary electrons from the walls are energetic enough to bombard adjacent rows of pixels, further degrading the image contrast. Such emitters as shown in FIG. 1 solve the past problem of non-uniform pixel brightness due to emission of only a few emitters.

Figure 2:
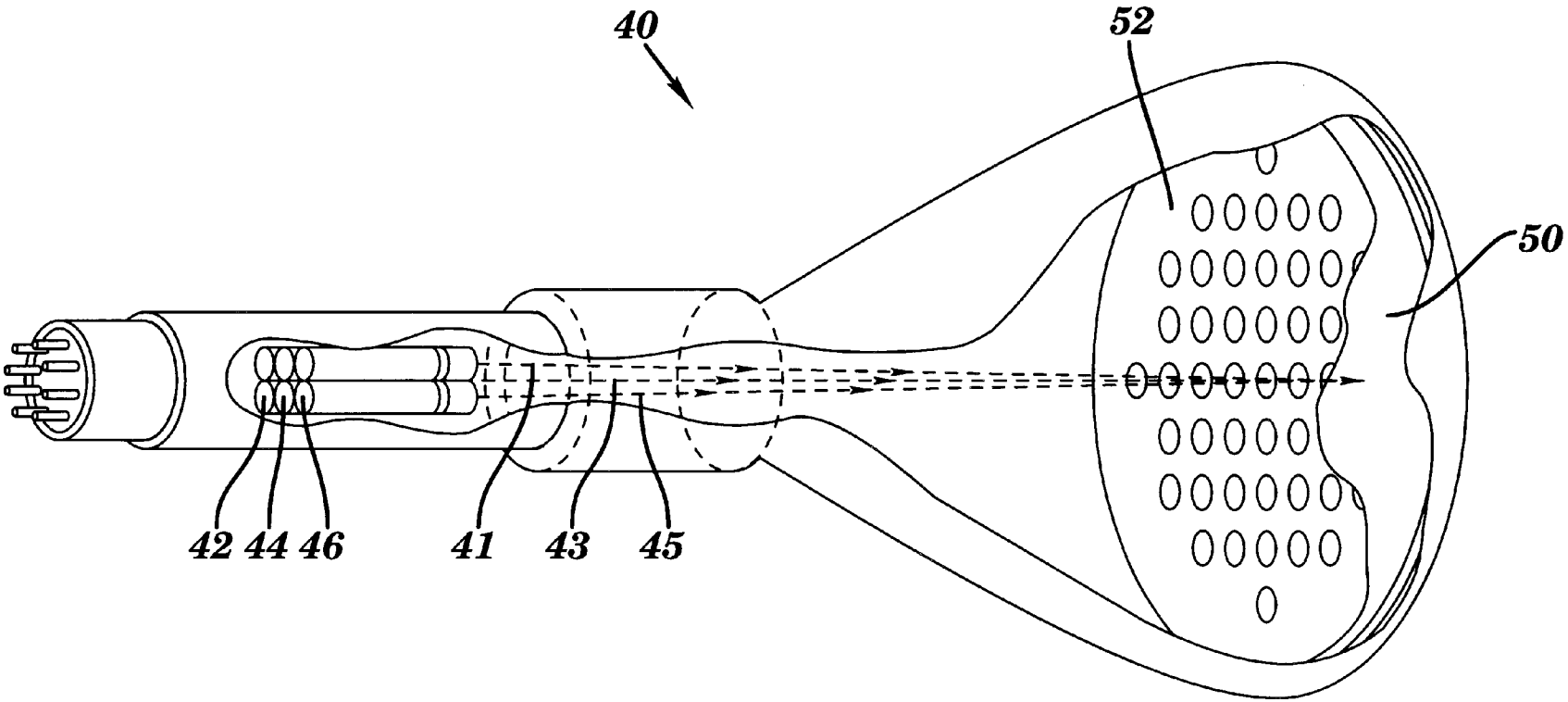
FIG. 2 is a schematic representation of a cathode ray tube with a perforated mask.

FIG. 2 depicts a color picture tube. The tube 40 has three electron guns 42, 44, and 46, which produce three separate electron beams 41, 43, 45. The beams are deflected in a standard pattern over the viewing screen 50. To permit three primary color images to be formed simultaneously, the screen comprises three sets of individual phosphor dots which glow respectively in three different colors, red, blue and green, and which are interspersed uniformly over the phosphor screen 50. The sorting out of the three beams so they produce images of only the intended color is performed by a mask 52 that lies directly behind the phosphor screen 50. The mask contains precisely located holes, each aligned with three different colored phosphor dots on the screen in front thereof. Electrons from the beams delivered by the three guns pass together through each hole, but each electron beam is directed at a slightly different angle. The angles are such that the electrons from one gun fall only on the dots from that color, being prevented from landing on the wrong dots by the shadowing action of the mask.

However, some electrons fall on the grille and the secondary electrons thus emitted cause image contrast loss. When the coatings of the present invention are provided to the mask, secondary electron generation is suppressed and picture contrast and overall picture quality is improved.

Figure 3:
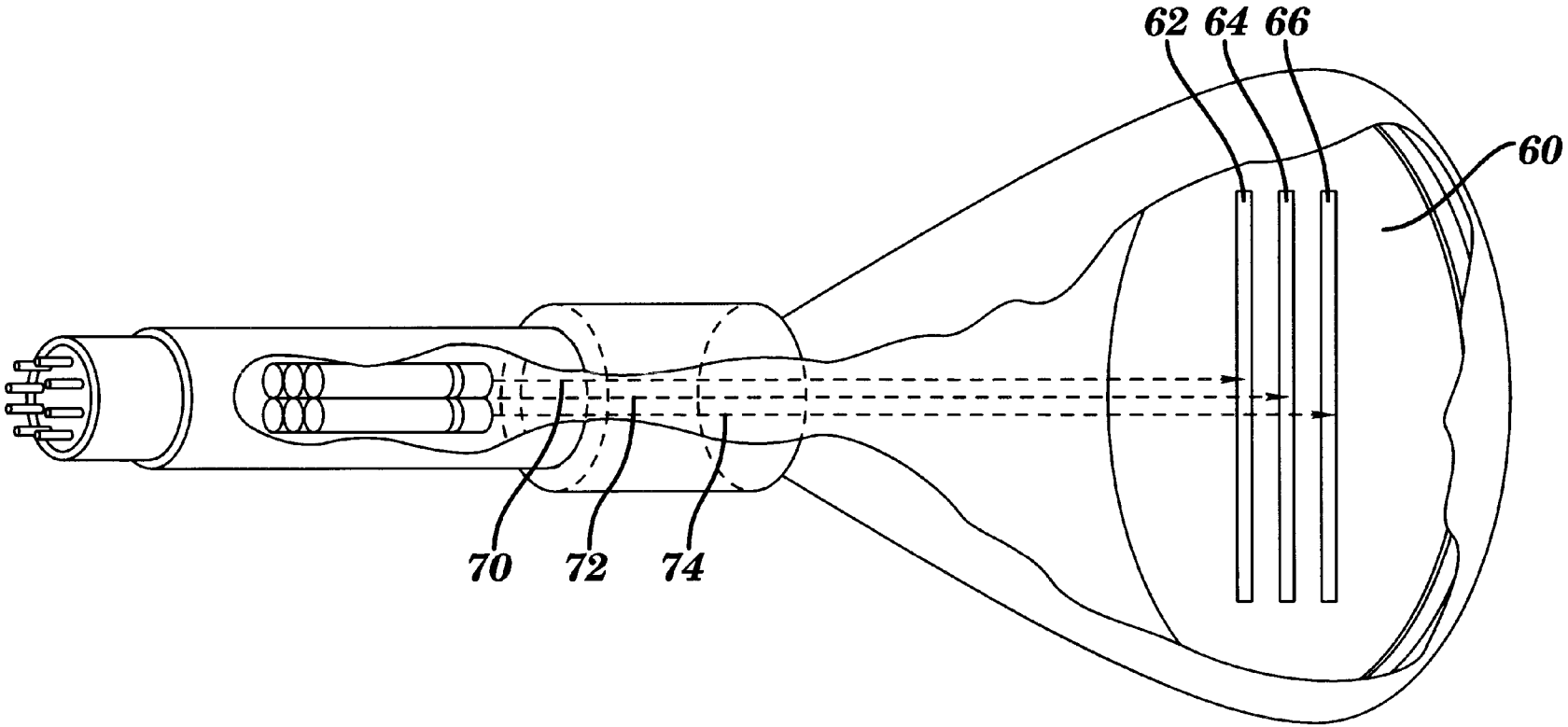
FIG. 3 is a schematic representation of a cathode ray tube with vertically slit grille.

In modern tubes, as shown in FIG. 3, the shadow mask is replaced by a metal grille 60 having vertical slits 62, 64, 66 extending from top to bottom. The three electron beams 70, 72, and 74 pass though the slits 62, 64, 66 to the colored phosphors (red, blue and green), which are in the form of vertical stripes (not shown). The grille 60 directs the majority of the electrons through the slits. Fewer electrons are intercepted by the grille as compared to the mask, resulting in a brighter picture. According to the present invention, the application of the low SEEC coating to the grille suppresses electron scattering, and lowers secondary electron counts, thus improving picture contrast.

The preferred coatings of the present invention are preferably diamond-like carbon-containing coatings synthesized via a glow discharge plasma process as would be readily understood by one skilled in the field of thin film deposition. Carbon-containing particle beams can be produced by plasma discharge in a plasmatron and extracted as charged particles by a high-voltage field in a vacuum chamber and directed onto the substrate. The composition of the coatings of the present invention include but are not limited to the coatings that are the subject of U.S. Pat. No. 5,466,431 the entire content of which is incorporated by reference herein.

Figure 4:
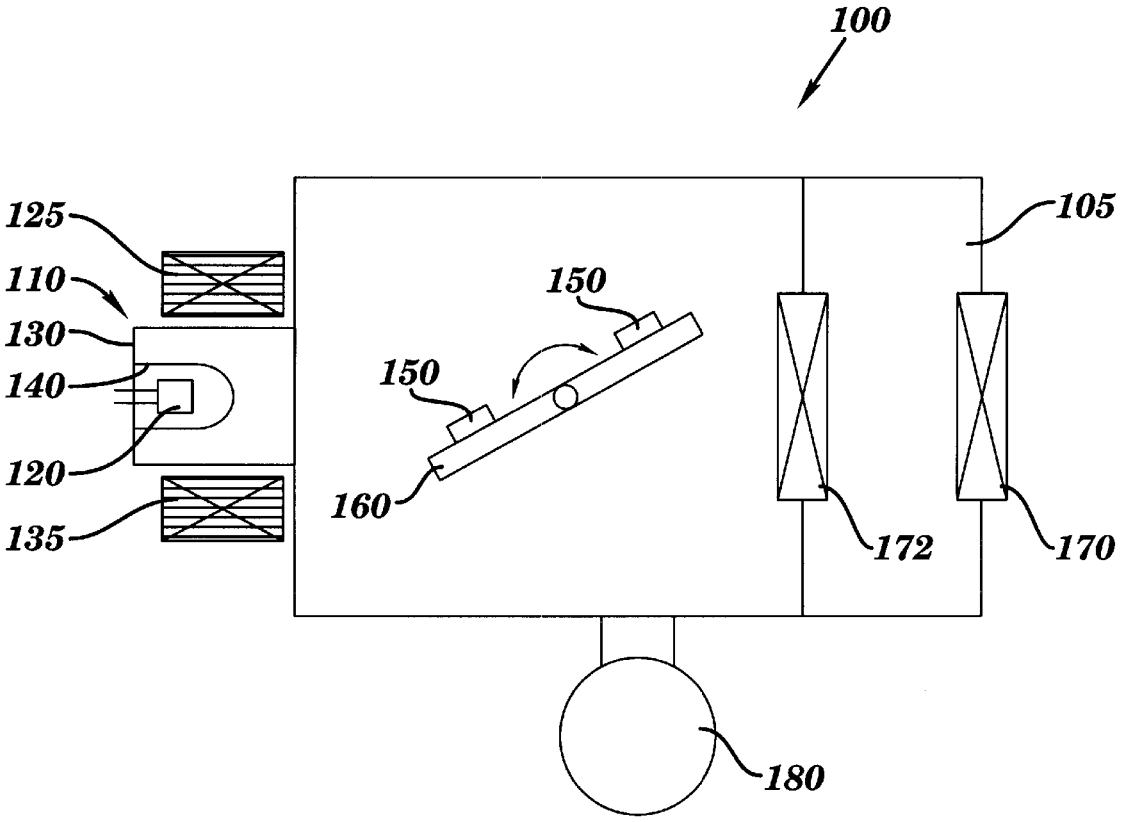
FIG. 4 is a schematic diagram detailing a preferred material fabrication and deposition chamber.

FIG. 4 shows one preferred embodiment of the coating chamber used for depositing the preferred diamond-like carbon-containing coatings. A vacuum deposition chamber 100 is provided to coat a substrate sample. A precursor inlet system 110, comprises a metal tube and a diffuser head 120 through which a liquid precursor, preferably a polysiloxane, is injected. The precursor inlet system 110 is shown incorporated into the chamber 100 through the chamber base plate 130. The samples are loaded into the chamber through the load lock 105. The chamber comprises a resistively heated tungsten filament 140. Substrates 150 to be coated are attached to the substrate holder 160. A power supply is used for biasing the substrates (DC or RF). In practice, the system is "pumped down" using normal vacuum pumpdown procedures. Gate valves 170, 172 are closed and the system is backfilled with dry air, nitrogen or argon until the chamber reaches atmospheric pressure. The chamber, is then opened and substrates 150 to be coated are attached to the substrate holder 160 using any fixtures or fastening means including clips, screws, clamps, etc.

The high vacuum is achieved by roughing down the chamber with a mechanical pump followed by pumping with a high vacuum pump 180. The pump can be a diffusion pump, turbomolecular pump, cryogenic pump, or other high vacuum pumps known in the field of vacuum technology. The coatings required according to the process of the present invention can be carried out in a batch type process for small volumes. In such instance, the substrates are mounted on a substrate holder inside the deposition chamber, the chamber is evacuated, the deposition is performed, and the chamber is vented, followed by removal of the coated parts (substrates).

The precursor can also be introduced into the deposition chamber by liquid-to-vapor delivery system. The precursor is flash evaporated into a vapor. A mass flow controller is used to precisely control the flow rate of the precursor vapor. While not required, a mixing gas, such as argon can be used to assist precursor evaporation.

For larger volumes, the process of the present invention can be carried out in an air-to-air system. Such air-to-air system could consist of cleaning, transport of parts to the deposition chamber, and mechanized/robotic loading of the parts on the substrate holder. This is followed by entry of the substrate holder into the load-lock chamber, by entry into the deposition chamber, and coating. The coated parts on the substrate holder can then be removed from the deposition chamber. It is understood that the substrates to be coated may be rotated, tilted, or otherwise oriented, or manipulated while on the substrate holder, and at other instances during processing.

The chambers are evacuated to a base pressure below $10^{-5}$ Torr after loading the substrates. Argon gas is then introduced into the chamber to raise the chamber pressure to $10^{-3}$ to $10^{-4}$ Torr. The substrates are then argon ion cleaned inside the deposition chamber before coating.

The argon ion cleaning is accomplished by either of two methods: glow discharge cleaning or filament assisted plasma cleaning. In glow discharge cleaning, the argon gas is introduced until the chamber pressure is in the $10^{-3}$ Torr range. A glow discharge is excited by RF or DC. During the discharge, a substrate bias of from about 0.03 to about 5.0 kV can be used. The frequency of the RF is in the range of 90–450 kHz. For plasma cleaning, the argon ions are created by a hot filament discharge and the chamber pressure is in the $10^{-4}$ Torr range. The temperature of the filament is in the range of from about 1400 to about 2500° C., with a DC filament bias of from about 70 to about 150 V. The substrates are biased by either RF or DC as mentioned above. Other ion sources known in the field of deposition coating can be used for ion generation, such as, Kauffman type ion sources, RF coil, etc. In addition to argon ion etching, other plasma cleaning can be performed by the introduction of small amounts of oxygen gas in addition to the argon gas. This process has been found to efficiently remove hydrocarbon contamination, oxide layers, and other contaminants, as well as improving the adhesion of coatings deposited on some substrates.

Towards the end of the substrate cleaning, organosilicon precursors, preferably siloxanes which contain C, H, Si, and O are introduced into the chamber. These precursors preferably have 1 to 10 silicon atoms. The preferred precursor is a polyphenylmethylsiloxane with 2-3-4 triphenyl-nonamethyl-pentasiloxane being particularly preferred. The precursor is introduced directly into the active plasma region using a microporous ceramic or metallic dispenser which is heated by the hot filament. The precursor can be mixed with other gases, both inert (argon as the feed gas) and active gases such as methane, acetylene, butane, etc. The hot filament photon and electron emission causes fragmentation and ionization of the precursor. The precursor can also be introduced into the system using liquid delivery systems consisting of flow controller, a heater, and a dispenser as known in the field. In the case of liquid delivery systems, the source of electrons can be a hot filament isolated from the precursor delivery system. As already described, the precursor can be admitted to the chamber via vapor feed.

Metal-containing species can be incorporated into the growing films and coatings by many methods: (a) thermal evaporation; (b) ion sputtering; (c) ion beams, etc. The metal beams are directed toward the substrate by the appropriate placement of the sources.

Variations of the above described deposition process include: (a) the use of sputtered silicon and oxygen gas as sources for Si and O; (b) use of solid $SiO_2$ as a source for Si and O; (c) use of $SiH_4$ and oxygen-containing gases as sources for Si; (d) use of a graphite target, hydrogen, and hydrocarbon gases as sources of C and H; and (e) use of metal-containing organosilicon compounds as sources of C, H, Si, O and metal. Combinations of the aformentioned methods may be used. The coating deposition preferably is sustained by a RF capacitively coupled discharge (CCD).

The organosilicon precursor can be introduced by either a separately heated microporous ceramic or metallic dispenser, or one of the liquid vapor injection systems described previously. The precursor can be mixed with other gases, both inert with argon as the feed gas, or active gases such as methane, acetylene, butane, etc., to achieve deposition pressures typically in the $10^{-2}$ Torr range. A single plate or parallel plate configuration can be used. The substrates are attached to one of the plates. RF or PDC voltage is then applied. In the case of a capacitive RF discharge, the frequency of the RF is in the range of 100 kHz to 100 Mhz. In another method, a large RF antenna can be placed inside the chamber to excite the discharge. The antenna can be made of copper, stainless steel, or other known state of the art materials. A protective coating, such as porcelain, can be applied to the surface of the antenna to prevent sputtering. An alternative method for injection of the siloxane precursors is to use direct injection from a diffusion pump.

The formation of dopant-containing beams may be realized by any one of, or combination of, the following methods: 1) thermal evaporation; 2) ion-sputtering; 3) ion beams. The dopant-containing beams are directed onto the growing film surface through the vacuum chamber. A DC of RF potential is generally applied to the substrates during the deposition process. No external substrate heating is required, but heating may be used if desired. The substrate holder may be designed specifically to hold parts of different shapes such as cylinders, as would be readily apparent to one skilled in the field. Useful variations of the above described deposition methods include the use of sputtered silicon and oxygen gas as precursors for silicon and oxygen, the use of sputtered carbon and hydrogen or hydrocarbon gas used as carbon and hydrogen precursors, or any combination thereof.

Preferred dopant elements to be used in the coatings of the present application and which are particularly effective for use in coatings for electrical displays and cathode ray tubes include Ti, Zr, Cr, Re, Hf, Cu, Al, N, Ag, and Au, with Ti being particularly preferred. Most importantly, the deposition may be "tuned" to meet the properties required for a particular application. This is done by altering the concentration of metal dopant co-deposited with the carbon, hydrogen, silicon and oxygen. In the present invention it is to be understood that dielectric coatings include both non-conductive and slightly conductive coatings. For non-conductive coatings, no dopant may be included. For coatings with electrical conductivity, increasing amounts of dopant may be included in the deposited coating.

The following examples serve only to further illustrate aspects of the present invention and should not be construed as limiting the invention.

EXAMPLE 1

Rectangular ceramic wafer substrates (6"×4"×10 mils thick) were arranged on a holder equidistant, 2 cm, from the center of the plasma reaction chamber interior. The holder is electrically isolated from the vacuum chamber. The substrates were arranged on two different holders, each of which was rotated at a rate of about 7 rpm. The plasma reactor was evacuated to $10^{-6}$ Torr by means of a rotary mechanical pump and a diffusion pump connected to pumping ports. The articles were cleaned further with an in-situ argon plasma clean. Argon gas (99.9999%) was introduced into the plasma reactor through the inlet port on the bottom of the plasma reactor. The argon flow rate was controlled by an electronically controlled mass flow controller. At the same time, the diffusion pumps were throttled and chamber pressure was maintained principally by a rotary mechanical pump and a roots blower. The argon flow was adjusted to achieve a pressure of $10^{-3}$ Torr. Then, an argon plasma discharge was induced by the application of RF power (130 Watts, 2 kHz) to the substrate holder. The substrate bias voltage is 300 V+/−30 V. Argon ions are accelerated across an electrostatic conformal plasma sheath which surrounds the articles on the holder. These ions bombard the surface of the articles to be coated and effectively remove residual organic, water, and other contaminants which were not removed by wet chemical etching. This cleaning was applied for 15 minutes and was terminated by turning off the RF power. The substrate temperatures were estimated not to exceed 50° C. during this process.

A liquid siloxane precursor, 2-3-4 triphenyl-nonamethyl-pentasiloxane and argon gas were introduced into the chamber at a flow rate of 0.3 cc/min. and 20 cc/min. respectively, so that the pressure in the plasma reactor was $2\times10^{-4}$ Torr. A substrate bias voltage of 500 V was applied to the articles. Titanium was chosen as the metal dopant. To achieve a coating with an electrical resistivity in the range of $10^8$ to $10^{10}$ Ω-cm, the magnetron sputtering method was chosen. The sputtering was conducted simultaneously with the plasma chemical vapor deposition at a pressure of $2\times10^{-4}$ Torr. The magnetron power was set to 85 Watts. A mechanical shutter was used to control film thickness and prevent unwanted deposition. The deposition proceeded for 45 seconds after the shutter was closed. The substrate bias was shut off and the power supplies to plasmatron and magnetron were gradually ramped down and shut off. The temperature of the substrates did not exceed 150° C. during the procedure. The coated substrates were cooled and then removed from the plasma chamber. It was determined that articles were coated with a 200 Angstrom coating having a resistivity of $10^9$ Ω-cm. The secondary electron emission coefficient (SEEC) was measured via a scanning electron microscope on the silicon coated substrate. The sample was placed on an electrically isolated specimen stage and the measurements were conducted. The beam current and specimen current were measured with an electrometer at an electron energy of 1 keV. The SEEC was determined to be 0.85.

Data shown in Table 1 includes film surface and bulk resistivity results measured using a Keithley 6517 Hi-Resistance Electrometer. For comparison, undoped (no Ti added) samples were also evaluated. The sheet resistance measurements were done on coated Kapton samples included in the coating run. The Ti doping measurements were taken using Rutherford Backscattering Spectroscopy (RBS) measurements.

EXAMPLE 2

Coating a High Voltage Spacer Used in a FED

The coated ceramic parts were assembled into a field emission display. The parts were diced with a diamond saw into thin strips, 0.0506" in height. The strips were assembled into a display which was then tested. The test was conducted for 20 hours. The maximum voltage at which the tube was operated reached 10 kV (DC). During these tests, the coating was bombarded with an electron dose of 0.02 coulombs/$cm^2$. The display voltage was checked periodically. No surface flashover or arching events were observed. In a control test, bare walls breakdown electrically and voltage regulation is difficult to achieve. The display with the coated walls performed much better relative to voltage control and power consumption. After the functional tests were completed, the display was dismantled and the electrical resistivity was measured. The spacer walls did not illuminate and could not be seen by an observer. In contrast, an uncoated spacer assembled in this display was clearly visible.

EXAMPLES 3–13

Conductivity

Electrical measurements were performed using a Keithley 6517 electrometer and a Keithley 8009 resistance test fixture (Keithley Instruments Inc., Cleveland, Ohio). The 6517 uses the ASTM D-257 measurement method, and displays measurements in resistance, surface resistivity, or volume resistivity. Thickness values required for calculating volume resistivity from sheet resistivity, were obtained using a Tencor Alpha-Step 500 Surface Profilometer (Tencor Instruments Inc., Milpitas, Calif.). During deposition, substrates were included which were partially masked off by a glass cover slip. After coating/deposition, the step height from the coated area to the uncoated masked area was measured, yielding film thickness. The Keithley gives sheet resistance values. Resistivity=ρ and was calculated from sheet resistivity ρ, and thickness t, using the formula $\rho_s=\rho/t$. The electron energy range over which the SEEC values rendered were less than about 1.0 was from about 80 to about 10,000 eV.

TABLE I

Conductivity of Samples

| Example # | Magnetron power (W) | Ti doping (atomic %) | Thickness (μm) | Sheet Resistance (Ω) | Resistivity (Ω-cm) |
|---|---|---|---|---|---|
| 3 DLN | 0 | | 1.89 | — | $4 \times 10^{13}$ |
| 4 DLN | 0 | | 0.80 | $4.8 \times 10^{14}$ | $3.8 \times 10^{10}$ |
| 5 DLN | 64.8 | | 0.82 | — | $1.1 \times 10^{9}$ |
| 6 DLN | 106.6 | | 0.79 | — | $7.0 \times 10^{7}$ |
| 7 DLN | 157 | | 0.74 | — | $2.9 \times 10^{5}$ |
| 8 DLN | 212 | | — | — | $2.9 \times 10^{4}$ |
| 9 Ti-DLN | 250 | 5 | 0.73 | 140,000 | 10.22 |
| 10 Ti-DLN | 500 | 8 | 0.44 | 21,000 | 0.92 |
| 11 Ti-DLN | 1000 | 20 | 0.26 | 2400 | 0.06 |
| 12 Ti-DLN | 2000 | 33 | 0.49 | 1800 | 0.08 |
| 13 Ti-DLN | 3000 | 40 | 0.44 | 1800 | 0.08 |

EXAMPLE 14

DLN Coatings on Interior of Picture Tubes

The coatings of the present invention are coated onto grille materials for color television image trubes at thicknesses of from about 0.02 to about 2.0 microns. The coated tubes yields a perceptably enhanced image contrast compared to uncoated tubes. These coatings display a secondary electron emission coefficient of less than 1.0.

EXAMPLES 15–23

Measurement of Secondary Electron Emission from Wafers and Walls

A scanning electron microscope (SEM) Model 6320FE (JEOL USA, Inc. Peabody. Mass.) is used for determining the electron emission along with a Keithley 602 electrometer and a digital multimeter. Samples are selected, loaded and mounted into a faraday cup containing a platinum aperture. Ten nm of Au or Cr/NiV is sputtered on the opposite side of the wafer before loading sample into the cup. A double shielded cable is attached between the electrometer and "N" connector on the SEM door. The chamber is pumped down to $10^{-7}$ Torr. range. The column valve is opened and the extraction voltage is turned on. The electrometer is zeroed and used to measure stability over time. The accelerator voltage is turned on to 1 keV (knob or PF7). The platinum aperture faraday cup is positioned under the beam. The beam is focused on aperture edge and the beam current stability is measured and monitored. The electrometer zero is rechecked by turning off the accelerated voltage. The beam current is measured and should be about $0.2\times10^{-11}$ Amps. The beam current is measured again and compared to the electrometer. The secondary emission (δ) is calculated according to the formula:

$$\delta=(I_b-I_s)/I_b$$

wherein $I_b$ is the beam current and $I_s$ is the specimen current.

TABLE 2

SEEC of Samples

| Example # | Film Type | δ at 1 keV | Thickness (Angstroms) | Resistivity (Ω-cm) |
|---|---|---|---|---|
| 15 | DLN | 0.88 | 180 | 1.40e + 7 |
| 16 | DLN | 0.88 | 750 | 1.30e + 12 |
| 17 | DLN | 0.93 | 140 | 1.50e + 11 |
| 18 | DLN | 0.89 | 110 | 1.30e + 11 |
| 19 | Ti-DLN | 0.87 | 288 | 1.00e + 10 |
| 20 | Ti-DLN | 0.98 | 510 | 2.90e + 11 |
| 21 | Ti-DLN | 0.95 | 1200 | 8.10e + 7 |
| 22 | Ti-DLN | 0.88 | 406 | 8.00e + 10 |
| 23 | Ti-DLN | 0.85 | 460 | 2.00e + 11 |

Many other modifications and variations of the present invention are possible to the skilled practitioner in the field in light of the teachings herein. It is therefore understood that, within the scope of the claims, the present invention can be practiced other than as herein specifically described.

What is claimed:

1. In a device having an electron source and a target arranged so that electrons from the source impinge on the target, and a passive element operationally positioned with respect to either the source or the target so that electrons from the source may impinge on the passive element and secondary electrons emitted from the passive element impinge on the target, the improvement comprising:

a coating comprising carbon and silicon on a surface of the passive element for reducing the secondary electron emission coefficient of the surface to less than about one.

2. The device according to claim 1, further comprising the coating on the target.

3. In a device having an electron source, a target arranged so that electrons from the source impinge on the target, and a passive element positioned so that electrons from the source may impinge on the passive element and secondary electrons emitted from the passive element impinge on the target, the improvement comprising:

a coating comprising carbon and silicon on a surface of the passive element for reducing the secondary electron emission coefficient of the surface to less than about one, wherein the coating has a thickness of from about 0.02 to about 0.15 microns.

4. The device according to claim 3, wherein the source comprises an electron gun.

5. The device according to claim 3, wherein the target comprises an cathodoluminescent screen.

6. The device according to claim 3, wherein the passive element comprises a spacer disposed between the source and the target.

7. The device according to claim 3, wherein the secondary electron emission coefficient is from about 1.0 to about 0.45.

8. The device according to claim 3, wherein the secondary electron emission coefficient is from about 0.90 to about 0.45.

9. The device according to claim 3, wherein the secondary electron emission coefficient is from about 0.9 to about 0.8.

10. The device according to claim 3, wherein the coating has a tunable electrical resistivity range over a range of from about $10^{-2}$ to about $10^{16}$ ohm-cm.

11. The device according to claim 3, wherein the coating has a tunable electrical resistivity range over a range of from about $10^{6}$ to about $10^{10}$ ohm-cm.

12. The device according to claim 3, wherein the coating comprises a diamond-like carbon-containing material comprising carbon, hydrogen, silicon and oxygen.

13. The device according to claim 12, wherein the carbon, silicon, hydrogen and oxygen are obtained from the decomposition of an organosiloxane having from about 1 to about 10 silicon atoms.

14. The device according to claim 13, wherein the organosiloxane is a polyphenylmethylsiloxane.

15. The device according to claim 3, wherein the coating further comprises dopant elements or dopant compounds containing elements from Groups 1–7b of the periodic table.

16. The device according to claim 15, wherein the dopant elements are selected from the group consisting of Ti, Zr, Cr, Re, Hf, Cu, Al, N, Ag, and Au.

17. The device according to claim 3, wherein the carbon content of the coating is from about 40 atomic % to about 98 atomic %.

18. The device according to claim 3, wherein the carbon content of the coating is from about 50 atomic % to about 98 atomic %.

19. The device according to claim 3, wherein the carbon to silicon atomic ratio of the coating is from about 2:1 to about 8:1.

20. The device according to claim 3 wherein the silicon to oxygen atomic ratio of the coating is from about 0.5:1 to about 3:1.

21. A color picture tube comprising:

at least one electron source;

a viewing screen arranged so that electrons emitting from the at least one source impinge on the screen;

a perforated shadow mask operationally positioned between the at least one source and the screen so that electrons emitting from the source may impinge on the shadow mask; and a coating made from the material of claim 1 disposed on the shadow mask, whereby formation of secondary electrons is substantially suppressed as electrons impinge on the shadow mask.

22. A field emission display comprising:

a baseplate;

a phosphor coated plate spaced apart from the baseplate;

an electron emitting array formed on the baseplate and positioned so that electrons emitted from the array impinge on the phosphor coating;

at least one spacer operationally positioned between and separating the baseplate and the phosphor coated plate; and a coating made from the material of claim 1 disposed on the at least one spacer, whereby formation of secondary electrons is substantially suppressed as electrons impinge on the at least one spacer.

23. A color picture tube comprising:

at least one electron source;

a viewing screen arranged so that electrons emitting from the at least one source impinge on the screen;

a grill having at least one slit operationally positioned between the at least one source and the screen so that electrons emitting from the at least one source may impinge on the grill; and a coating made from the material of claim 1 disposed on the grill, whereby formation of secondary electrons is substantially suppressed as electrons impinge on the grill.

* * * * *